United States Patent [19]

Murai

[11] Patent Number: 4,811,685

[45] Date of Patent: Mar. 14, 1989

[54] CARRIAGE-TYPE CONVEYOR

[75] Inventor: Masasumi Murai, Saitama, Japan

[73] Assignee: Tsubakimoto Chain Co., Osaka, Japan

[21] Appl. No.: 105,310

[22] Filed: Oct. 5, 1987

[30] Foreign Application Priority Data

| | | | |
|---|---|---|---|
| Oct. 7, 1986 | [JP] | Japan | 61-153141[U] |
| Nov. 18, 1986 | [JP] | Japan | 61-176048[U] |
| Dec. 17, 1986 | [JP] | Japan | 61-193051[U] |
| Jul. 28, 1987 | [JP] | Japan | 62-114539[U] |

[51] Int. Cl.[4] ..... B05B 15/12

[52] U.S. Cl. ..... 118/326; 118/324; 104/172.3; 104/140

[58] Field of Search ..... 104/172.3, 140; 118/324, 326

[56] References Cited

U.S. PATENT DOCUMENTS

| | | | |
|---|---|---|---|
| 3,518,946 | 7/1970 | Kavieff | 104/172.3 |
| 4,438,701 | 3/1984 | Murai et al. | 104/172 B |
| 4,542,698 | 9/1985 | Wakabayashi | 104/172.3 |
| 4,616,570 | 10/1986 | Dehne | 104/172.3 |
| 4,646,650 | 3/1987 | Kondo | 104/172.3 |
| 4,691,640 | 9/1987 | Murai | 104/140 |

FOREIGN PATENT DOCUMENTS

| | | | |
|---|---|---|---|
| 60-5966 | 1/1985 | Japan . | |
| 2093420 | 9/1982 | United Kingdom | 104/172.3 |

*Primary Examiner*—Shrive Beck

*Attorney, Agent, or Firm*—Dann, Dorfman, Herrell & Skillman

[57] ABSTRACT

Conveyor assemblies adapted for use in painting booths, embodying conveyor units having upper and lower frames spaced apart by post portions aligned in the direction of travel. A dust cover encloses the drive mechanism and has a top wall between the upper and lower frames. A slot is provided to permit passage of the aligned post portions, and the slot is covered by a resilient flexible flap which can be displaced by the post portions as they travel through the slot. The drive mechanism includes alternative drive chains, one of which has a pusher for effecting advance of the units, the other of which has a bifurcated coupling which may effect both advance and retraction of the units along their path of travel. The lower frame has swivelable wheels which may ride in the elevated wheel-guide tracks in the painting booth to provide stabilization of the frame against lateral sway.

14 Claims, 19 Drawing Sheets

CARRIAGE-TYPE CONVEYOR

DETAILED DESCRIPTION OF THE INVENTION

This invention relates to a carriage-type conveyor which is particularly suitable for use, for example, on a motor vehicle body coating, e.g. painting, and drying line The invention is designed to accommodate to the use of painting robots in the coating line.

BACKGROUND OF THE INVENTION

A carriage-type conveyor of this sort is disclosed in U.S. Pat. No. 4,438,701, wherein each carriage is linked to a carrier, which runs under the floor level, by means of a C-shaped coupling member which is offset in a lateral direction perpendicular to its direction of travel. Cover plates, each with a resilient strip attached to its fore end for sealing the passage of the vertical portion of the coupling member, are placed on the floor surface on which the carriage runs, thereby ensuring smooth movements of the carrier and chain while protecting them against intrusion and deposition of the paint used on the coating line or of the dust on the floor surface.

However, in the coating line, the paint deposits on the traveling wheels of the carriage, which are not provided with any dust cover. Deposited paint increases their rotational resistance or invites a problem of degradation of the coating quality by whirling paint dust since the paint on the wheels becomes loose after drying and falls everywhere in the coating line in a finely divided form.

On the other hand, Japanese Laid-Open Utility Model Application No. 60-5966 discloses a transfer system employing wheelless load support deck 1 which is free of the above-mentioned problems but unsuitable for use with coating robots due to inferior stability against sideward wavering movements.

Further, the load support deck which is supported by front and rear trolleys immovably in the vertical direction is driven by horizontal-axis wheels running on guide rails, so that a great load is imposed on the wheels and guide rails, causing considerable friction therebetween. In addition, the transfer system is held in overload condition when a foreign object gets into the gaps between the horizontal-axis wheels and guide rails, and, since the horizontal rollers are not castors, they skid sideward at curves. It is very likely that the rollers and guide rails suffer from localized abrasive wear. The above-mentioned phenomena all lend themselves to degrade the positional accuracy with respect to painting robots.

In case there is a necessity for switching the transfer of the load from continuous travel to intermittent travel for coating a work in a painting robot operating zone, for example, a continuous traveling conveyor and an intermittent traveling conveyor have to be juxtaposed at the switching point. However, it is difficult for the above-described prior art conveyors to meet this requirement due to a spatial problem.

SUMMARY OF THE INVENTION

In accordance with an aspect of the invention, the above-mentioned problems are solved by the provision of a conveyance unit consisting of a carrier having a wheeled lower frame and a load mounting upper frame securely connected by post members having vertical portions in alignment with each other in the direction travel; a coupler provided disengageably between a drive chain located beneath the carriage and a front portion of the carriage; an uncoupling member provided at the tail end of the carriage for releasing the coupler of a succeeding carriage when the latter approaches; and a fixed dust guard cover having a groove or slot in the top wall thereof to serve as a passage for the vertical portions of the posts and extending in the direction of travel to envelop the top surface of the lower frame and the opposite sides of the carriage beneath the lower frame.

The conveyance unit may be constituted by a single carriage, or by a carriage having front and rear carrier trucks connected to its front and rear ends for its guiding movements in the travel direction. In the latter case, a coupler is provided between the leading carrier of the front carrier truck and the drive chain, while providing an uncoupling member on the carrier at the tail end of the rear carrier truck for releasing the coupler of the succeeding carrier.

In this first aspect of the invention, a carriage which is longer than the carrying load is selected when the conveyance unit consists of a single carriage, although it may be shorter than the carrying load when carrier trucks are connected to the front and rear ends of the carriage to form a conveyance unit which is longer than the carrying load. In any case, the carrying load does not protrude beyond the front and rear ends of the conveyance unit, and therefore, after releasing the coupler, the conveyance units can be stored in a desired zone of the transfer path in end-to-end contact with each other.

In a coating booth, the dust guard cover envelops the conveyance portions beneath its lower frame except for the passage groove or slot in the top wall of the cover. Since the passage groove or slot is narrow in width, there is almost no possibility of the paint entering the dust cover therethrough. In a case where the passage slot is closed by a flap of a resilient material, like rubber, it becomes possible to prevent completely the paint deposition on the traveling wheels, couplers, drive chain, carrier trucks and the like.

Further, as soon as the coupler is released from the drive chain for storage by a stopper which projects into the path of travel, the conveyance unit is stopped, consecutively stopping the succeeding conveyance units upon the uncoupling of a preceding conveyance unit for storage. As the stopper is retracted, the leading one of the conveyance units in storage is started by engagement of the coupler with the drive chain, starting the succeeding conveyance units one after another by the drive chain.

In accordance with another aspect of the invention, the carriage-type conveyor essentially includes: a conveyance unit having a carriage with a wheeled lower frame and a load-carrying upper frame connected by post members having vertical portions aligned with each other in the traveling direction; a coupler provided on a front portion of the conveyance unit and releasably engageable with a drive chain provided beneath the conveyance unit in the travel direction; an uncoupling member provided at the tail end of the conveyance unit for releasing engagement of a succeeding carrier upon approach of the latter; a fixed dust guard cover extending along the travel path, the dust cover having a longitudinal groove or slot in the top wall thereof to provide a passage for the aforementioned vertical portions and enveloping the top surface of the lower frame and the opposite sides of the conveyance unit beneath the lower frame; and a fixed guide rail having a downward opening for receiving vertical-axis guide rollers within the fixed dust cover.

Similarly to the arrangement in the above-described first aspect of the invention, the conveyance unit may consist of a carriage alone or a carriage with front and rear carrier trucks connected to its fore and rear ends for guiding its movements in the travel direction.

In addition to the effects as in the first aspect of the invention, the conveyor in the second aspect is capable of preventing sideward wavering movements of the carriage by engagement of the vertical-axis rollers with the fixed guide rail to keep the load in an accurate position in lateral directions during travel.

In accordance with a third aspect of the invention, the carriage-type conveyor comprises: a carriage or pallet, a lower frame movable under guidance of a drive chain, and a load-carrying upper frame fixed on the lower frame by post members with vertical portions aligned with each other in the travel direction; a dust guard cover extending in the travel direction and having a longitudinal groove or slot in the top wall thereof to serve as a passage for the vertical portions, the dust cover enveloping the top surface of the lower frame and lateral side surfaces of the carriage or pallet beneath the top surface of the lower frame; a water feed pipe and a water discharge pipe for flowing paint-washing water into a tray on the dust guard cover; and a grating mounted on the tray.

With regard to the effects of the conveyor according to this third aspect of the invention, there is almost no possibility of the paint entering the dust guard cover in the coating booth since the dust cover envelops the top surface of the lower frame, except the narrow passage groove or slot in the top wall, as well as the opposite sides of the carriage or pallet below the lower frame, maintaining the lower frame and the lower part in clean state. The paint which drops into the tray through the apertures in the grating is washed away with cleaning water and discharged, with little paint deposition on the grating. Operators can safely walk on the dust cover thanks to the anti-slip effect of the grating. The paint which has become deposited on the grating can be removed by detaching and washing the grating in another place.

In accordance with a fourth aspect of the invention, there is provided a carriage-type conveyor including: a carriage with traveling wheels at four corners thereof; guide rails provided on part of the travel path for guiding the carriage and having a downslope portion at the opposite ends thereof; carriers to be moved by a drive chain along the guide rails for moving the carriage; and a coupler connecting the carriage to the carriers movably in vertical directions, the carriage being adapted to assume either a low travel position supported by the carriers or a high travel position where the travel wheels can run along the guide rails.

In this fourth aspect of the invention, the carriage in travel is normally supported by the carriers. As the carriage is moved, for example, to a point near the entrance of a coating booth, the traveling wheels ride onto the ramp portions of wheel guide rails, elevating the carriage as the wheels run up the entrance ramp portions. Within the coating booth, the carriage is advanced by the traveling wheels which roll on the wheel guide rails. Accordingly, at this time the carriers simply transmit the driving force, without bearing the load.

Past the coating booth, the carriage is lowered under the guidance of the exit ramp portions at the opposite ends, and moved forward, supported by the carriers at a position lower than the position for travel on the wheel guide rails.

Therefore, the carriage is moved by the traveling wheels in the coating booth where stable movement is required, and it is supported by the carriers in the lower travel position during movements in other portions of the transfer path.

BRIEF DESCRIPTION OF THE DRAWINGS

FIGS. 1 through 8 illustrate a first embodiment of the invention, of which FIG. 1 is a cross-section of the conveyor as a whole;

FIG. 2 is a perspective view of a carriage;

FIG. 3 is a frontal elevation of the carriage;

FIG. 4 is a lefthand side view of the carriage;

FIG. 5 is a frontal elevation of a carrier;

FIG. 6 is an elevation of a leading end coupler;

FIG. 7 is a view similar to FIG. 6 but showing the coupler in released state; and FIG. 8 is an elevation on an enlarged scale of an alternate direct drive mechanism for the carriage in the conveyor shown in FIG. 1;

FIGS. 9 through 11 illustrate another embodiment of the invention, of which FIG. 9 is a frontal elevation of a conveyance unit;

FIG. 10 is a schematic side view of the carrier within a coating booth; and

FIG. 11 is an elevation of a coupling mechanism;

FIGS. 14 through 21 illustrate a further embodiment of the carriage-type conveyor, of which FIGS. 14 and 15 are schematic frontal views of the conveyor as a whole, FIG. 14 showing a carriage passing toward the exit end of a dust cover in a coating booth and FIG. 15 showing the carriage passing toward the entrance end of the dust cover;

FIG. 16 is a sectional view taken on line 16—16 of FIG. 14;

FIG. 17 is an enlarged fragmentary view showing the coupler shown in FIG. 16;

FIG. 18 is a frontal view of the coupler of FIG. 17;

FIG. 19 is a sectional view taken on line 19—19 of FIG. 15;

FIG. 20 is a frontal view of major components of the conveyor shown in FIG. 15; and FIG. 21 is an enlarged perspective view of the entrance end of a gutter-like wheel guide rail employed in this embodiment of the invention.

PREFERRED EMBODIMENTS

Figure 1:
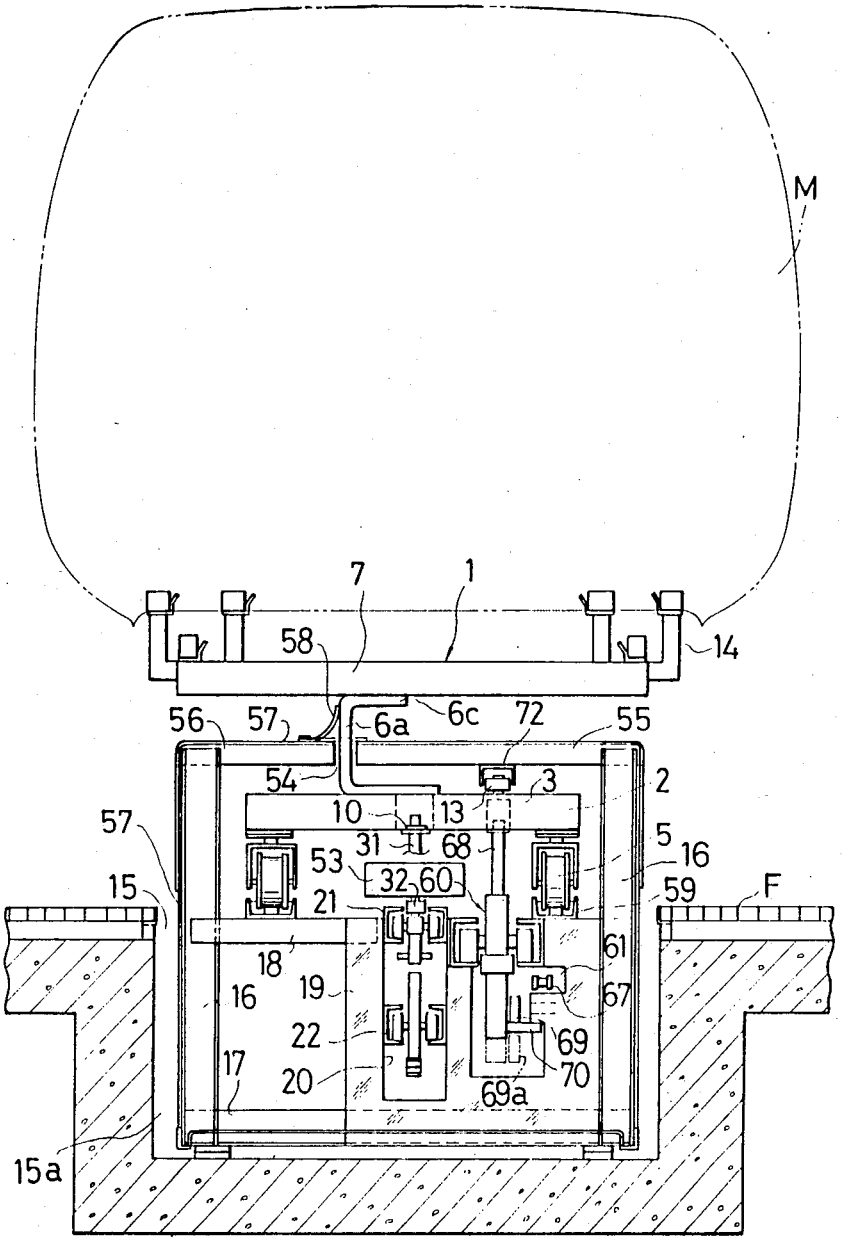
Figure 2:
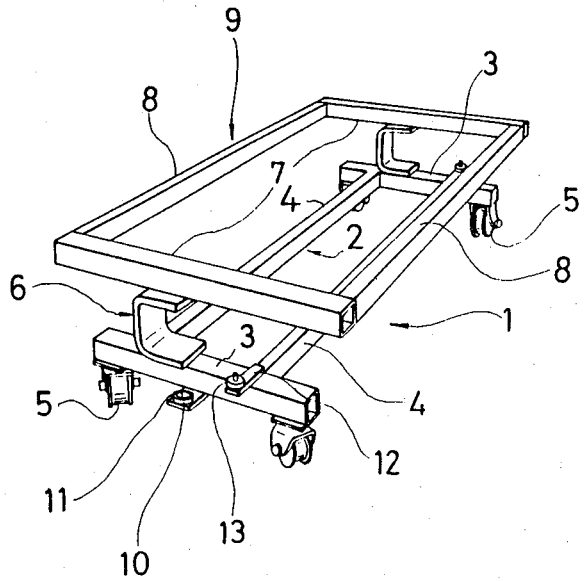
Figure 3:
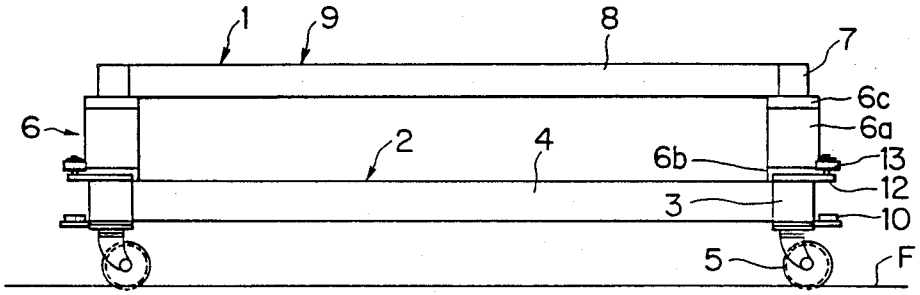
Figure 4:
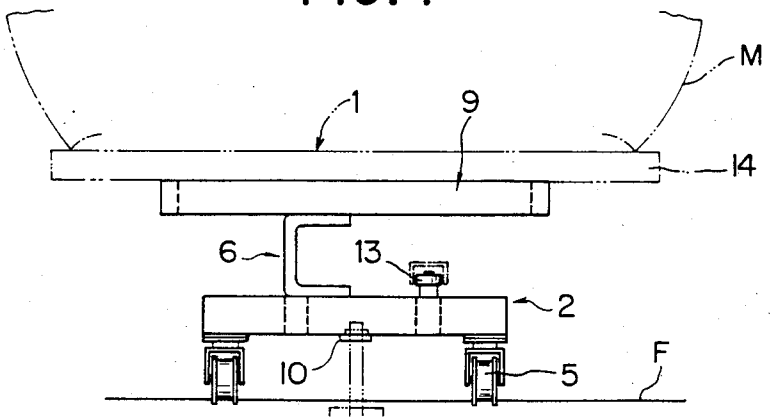

Referring to FIGS. 1 through 8, there is shown an embodiment in which the conveyance unit has carrier trucks connected to the fore and rear ends of a carriage. The carriage 1 includes a lower frame 2 which is formed by welding transverse frame members 3 to longitudinal frame members 4 extending in the travel direction. Each transverse frame member 3 has swivelable wheels 5 at the opposite ends thereof. As shown in FIGS. 1 and 3, a post member 6, for example, of channel- or I-shape has a vertical portion 6*a* of a small thickness in the lateral direction, and a lower end 6*b* fixed on each transverse frame member 3 at a position so that the vertical portion 6*a* is offset from the medial centerline of the path of travel and the vertical portions 6*a* of the post members 6 on the respective transverse frame members are aligned with each other in the travel direction. The upper ends 6*c* of the post members 6 are securely fixed to transverse frame members 7 which are welded to longitudinal frame members 8 to form an upper frame 9.

The upper and lower frames 9 and 2 have their respective longitudinal axes aligned with each other, and a coupling member 10 with a coupling hole 11 projects outward from the center of each one of the front and rear transverse frame members 3. A bracket 12 projects outward from the top surface of each transverse frame member 3 at a position which is offset from the medial centerline of the frame member, opposite to the vertical portion 6*a*, and rotatably supports a vertical-axis guide roller 13. Details of the guide rollers 13 will be described hereinafter. The upper frame 9 has receptacle members 14 (not shown in FIG. 2, but see FIG. 1) at suitable positions for supporting a large-size load, for example, a motor vehicle body M.

As shown in FIG. 1, a pit 15 is provided beneath the floor surface along the path of travel 15*a* of the carriage 1. In the pit 15, vertical support columns 16 are erected at predetermined intervals along the opposite side walls thereof. A support plate 19 is securely fixed to a support column 16 on one side and is secured at the other side to a cross member 17 and a beam 18, which are in turn fixed on the support columns 16 respectively at the lower ends and at the level of the floor surface F. Each support plate 19 is provided with a U-shaped groove 20 in which paired channel members are fixed to form a carrier rail 21 in an upper portion and a chain guide rail 22 in a lower portion thereof. The upper surface of the carrier rail 21 is substantially flush with the floor surface F.

Figure 5:
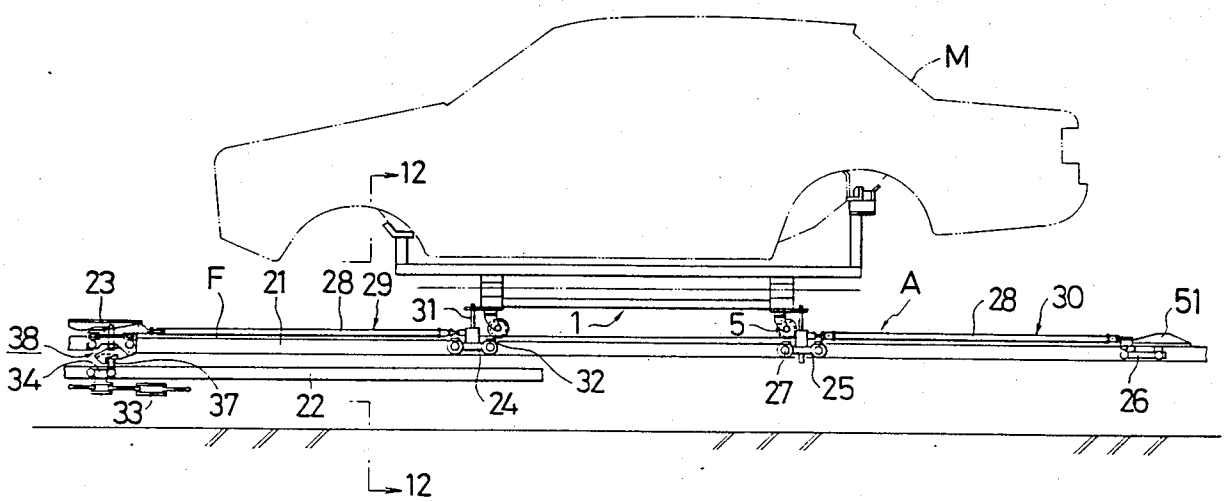

As shown in FIG. 5, four rollers 27 are provided on each one of carriers 23 to 26 which are connected to the carriage 1. The rollers 27 are loosely fitted in the carrier rail 21 for moving the carriage therealong under their guidance. A head carrier 23 and a trailing carrier 24 on the front side as well as a follower carrier 25 and a tail carrier 26 on the rear side are flexibly connected by connecting rods 28 which are exposed above the floor surface, forming a front carrier truck 29 and a rear carrier truck 30. Tow pins 31 project upwardly from the carriers 24 and 25 (FIGS. 1 and 5), and are fitted in the coupling holes 11 at the fore and rear ends of the carriage 1 to form a conveyance unit A with the front and rear carrier trucks 29 and 30 connected to the carriage 1, and free for vertical movement relative thereto. At 32 (FIG. 6), a vertical-axis guide roller is rotatable on the carrier between and above the level of wheels 27, so as to be positioned between the opposing upper edges of the rail 21 to prevent sideward rocking movements of the carrier.

Figure 6:
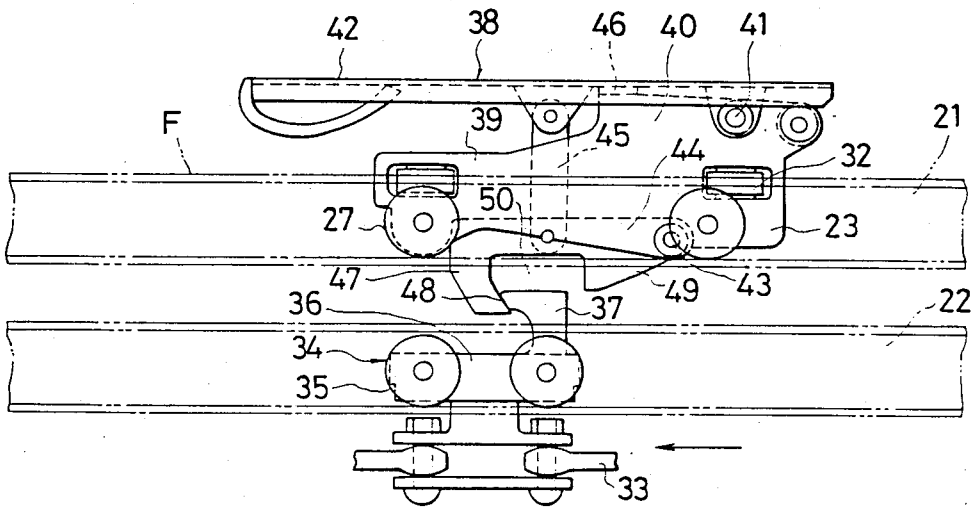
Figure 7:
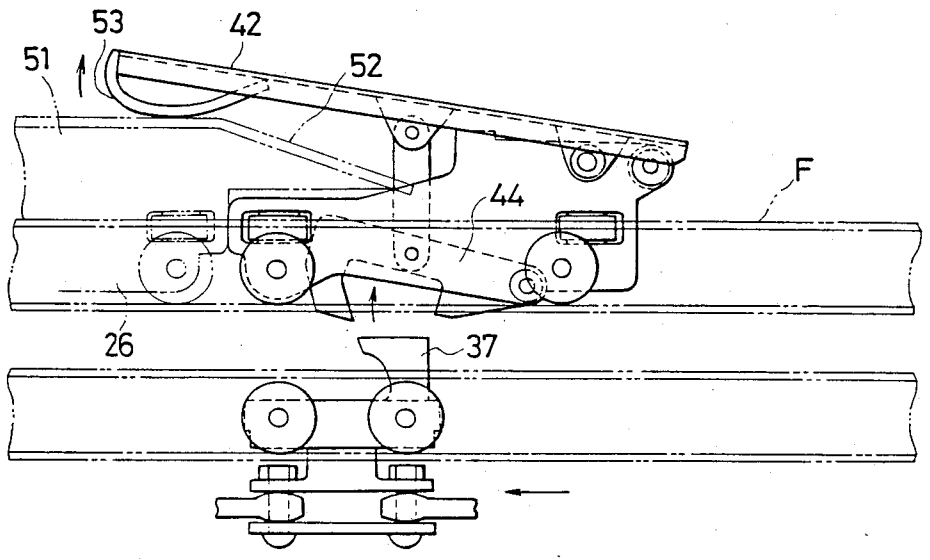

As shown in FIGS. 6 and 7, a chain guide rail 22 guides the movement of a roller 35 of a trolley 34 which suspends a drive chain 33 for the conveyance unit A. The drive chain 33 is horizontally flexible, and extends along the path of travel of the conveyance unit A. A pusher 37 for driving the head carrier 23 projects upwardly from the body 36 of the trolley 34, while a coupler 38 which is engageable with the pusher 37 is provided on the head carrier 23.

The coupler 38 includes: a main body 39 on which the rollers 27 of the head carrier 23 are journalled; a lever 42 which is pivotally mounted by pins 41 on a body portion 40 which projects above the floor surface F; a hook member 44 pivotally connected at 43 to a lower rear portion of the main body 39; and a link 45 connecting the lever 42 with the hook member 44. Normally the lever 42 is urged by its own weight into engagement with a projection 46 on the body portion 40, and in this position a hook 47 formed in a front portion of the hook member 44 falls in the path of movement of the pusher so that it is engageable with the pusher 37. The front and rear surfaces of the hook 47 are inclined rearward to ensure secure engagement with a forwardly projecting inclined surface 48 in forward drive of the conveyance unit A. If the pusher 37 is advanced when the conveyor A is at rest, it abuts against the rear inclined surface 49 of the hook member 44, and cams it upwardly, together with the lever 42, to allow the pusher to enter a recess 50, engaging with the hook 47 as the hook member 44 is lowered by gravity or by engagement of the pusher with the rearward inclined surface of the hook portion 47.

On the other hand, the carrier 26 at the tail end is provided with an upcoupling member 51 (see FIG. 7) which extends above the floor surface F and has a rear inclined surface 52. If a curved portion 53 at the fore end of the lever 42 of a succeeding conveyance unit A rides up the surface 52, the succeeding unit A is stopped since the hook member 44 of the succeeding conveyance unit A is lifted up and released from the pusher 37.

The unit A may also be uncoupled or disengaged from the drive chain at a fixed point in the path of travel by a stopper which may be projected into the path of the shoe portion 53 from alongside the path. Accordingly, if the lever 42 of a first conveyance unit A is pivoted up and disengaged from the pusher 37 by a stopper, not shown, protruding into the travel path from one side thereof, the succeeding conveyance units A are stopped one after another as they are released from the pusher 37 by the uncoupling member 51 of a preceding conveyance unit A. If the stopper is retracted, the hook member 44 of the leading one of the stopped conveyor units is lowered and moved forward by engagement with an advancing pusher 37. By this forward movement, the hook member 44 of the next stopped conveyor unit A is lowered to start the conveyor in the same manner. Consequently, it is possible to store the conveyor units A in a desired zone of the travel path and to start automatically the conveyor units A which are in storage one after another.

In order to store the loads M in the above-described manner, it is necessary to select conveyance units A of a larger length than the load M. However, the carriages 1 which are easily separable from the carrier trucks 29 and 30 provide various conveniences in use, such as separate storage and replacements by carrier trucks of a desired length.

It is possible to render the drive inoperative by increasing the vertical spacing between the rails 21 and 22 sufficiently so that the pusher 37 passes below the hook 47 without engaging the inclined surface 48. Latching the shoe portion 53 in its elevated position also inactivates the drive.

In a painting booth, opposing beam members 55 and 56 have their outer ends fixed on the upper ends of the support columns 16 at the opposite sides of the pit and are spaced apart at their inner ends but confront one another to provide a passage groove or slot 54 for the vertical portions 6*a*. Covering the top surfaces of these beam members and the support column portions above the floor surface is a dust cover 57 which, in a tunnel-like fashion, encloses the upper portions of the opposite side walls of the pit 15.

In order to prevent the paint from entering through the passage slot 54 and contaminating the carrier chains 29 and 30 and the drive chain 33, the positions of the vertical portions 6*a* and the passage groove 54 are offset from the longitudinal center of the carriage 1. The passage slot 54 may be left open in case its width is small. However, to enhance the shielding effect of the dust guard cover 57, it is preferred to cover the passage groove 54 with at least one flap 58 of a flexible resilient sheet which has one longitudinal side thereof fixed on the dust cover such that the free side of the resilient sheet 58 is locally turned up when a vertical portion 6*a* passes.

With the above-described construction, the paint is completely prevented from depositing on the movable parts below the lower frame 2, namely, on the swivelable wheels 5, carrier chains 29 and 30, drive chain 33, trolley rollers 35 and the like, eliminating the conventional problems such as the increased travel resistance and coating defects.

Within the coating booth, the carriage 1 is completely grounded during an electrostatic spray coating operation, by running the wheels 5 through water which flows through gutter-like rails 59.

In case painting robots are employed in the painting booth, it is desirable to use an alternative secondary carriage drive mechanism 60 instead of the drive chain 33, for the purpose of enhancing the accuracy of movement and stop positions of the carriage 1 to facilitate the programming of the robots. The secondary drive mechanism may temporarily stop the carriage in association with operations by the coating robots.

Figure 8:
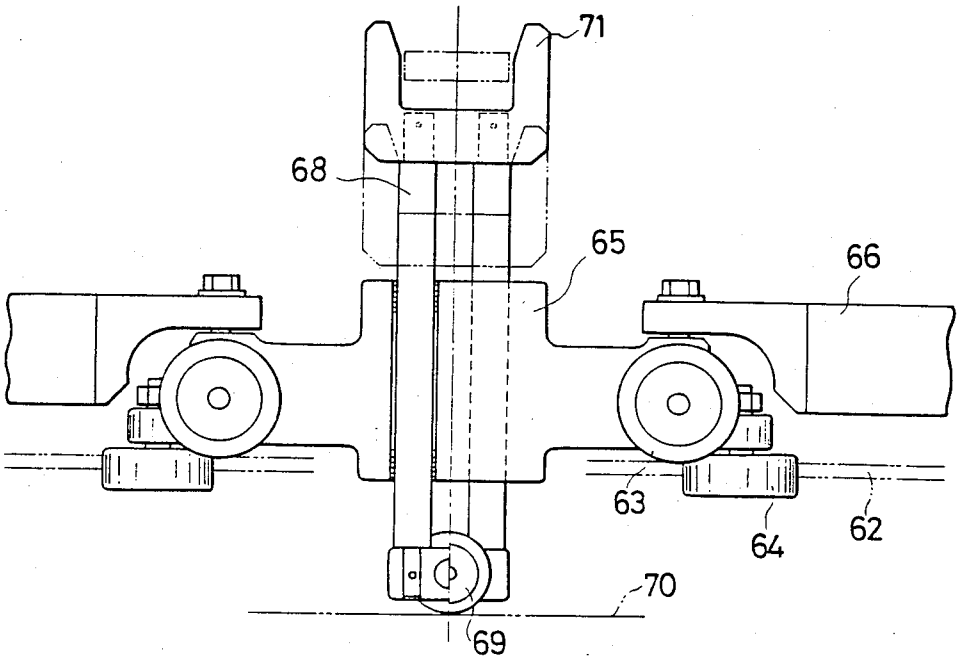

To this end, the secondary carriage drive mechanism 60 includes, as shown in FIGS. 1 and 8, a track 62 consisting of a pair of channel members fixedly supported in a cut-out 61 which is formed in the support plate 19 contiguously on one side of the rail 21, a truck 65 with connecting rods 66 for flexibly connecting a large number of trucks 65 each having front and rear rollers 63 fitted in the track 62 and vertical-axis guide rollers 64 between the pair of channel members, an endless drive chain 67 having the opposite ends thereof fastened to each other to drive the trucks in the forward and reverse directions, and an upstanding coupling rod 68 guided against rotational movement about its upright axis by the truck 65 for upward and downward movements. The secondary drive 60 may be confined to the portion of the path of travel where the conveyance units A pass by painting robots. The trucks and the connecting rods may be connected as an endless chain which may be driven by a drive unit controlled in unison with the painting robots, avoiding the need for the separate drive chain 67.

A cam roller is rotatably supported on one side of a lower portion of the coupling rod 68 and rides upon a cam plate 70 which is fixed on the support plate 19, thereby retaining the coupling rod 68 in a lifted position, shown in full lines in FIG. 8. In this state, a bifurcated coupling portion 71 at the upper end of the coupling rod 68 is engaged with a beam member 3 of the lower frame of the carriage 1 for controlled advancement by the alternate drive mechanism 60. Accordingly, the carriage 1 is transferred with high accuracy in travel position. After finishing a transfer, part of the cam plates 70 is lowered by a cylinder or the like, and the cam roller 69 recedes to the lower position shown in broken lines at 69*a*. The coupling rod follows the lowered part of the cam plate 70 at a recession limit position and raises again with the cam plates 70 when the lowered part is lifted up.

The coupling rod 68 is offset from the longitudinal center line of the carriage 1 oppositely to the offset vertical portion 6*a* of the post member 6, and therefore the pushing force from the alternate drive 60 imparts a rotational moment to the carriage 1. The vertical-axis guide roller 13 which is journalled on the transverse member 3 is fitted in a downwardly open guide rail 72 formed by channel members which are fixed on the lower side of beam members 55, thereby counteracting the aforementioned rotational moment. Further, since the guide roller 13 is covered by the guide rail 72, there is no possibility of the paint depositing on the interior surfaces of the guide rail or on the roller 13.

It is noted that when the alternative secondary drive 60 is operative, the chain rail 22 is spaced below the rail 21 so that the pusher 37 does not engage the hook 48.

Figure 9:
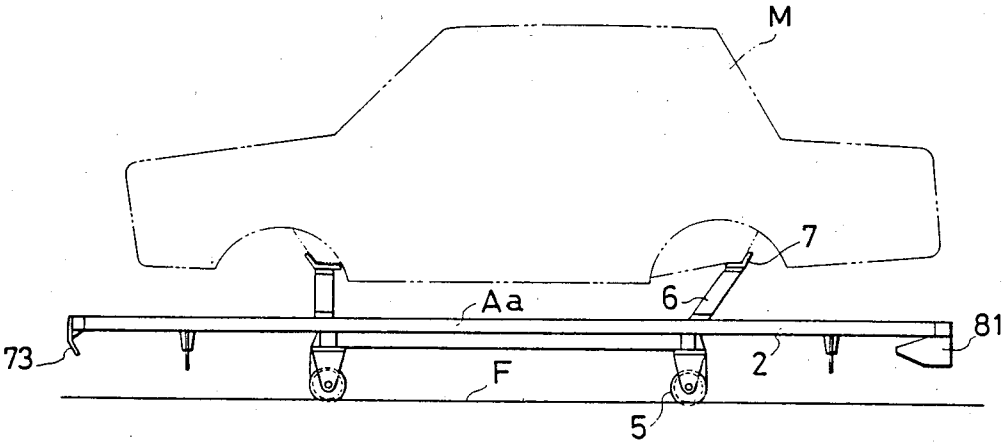
Figure 10:
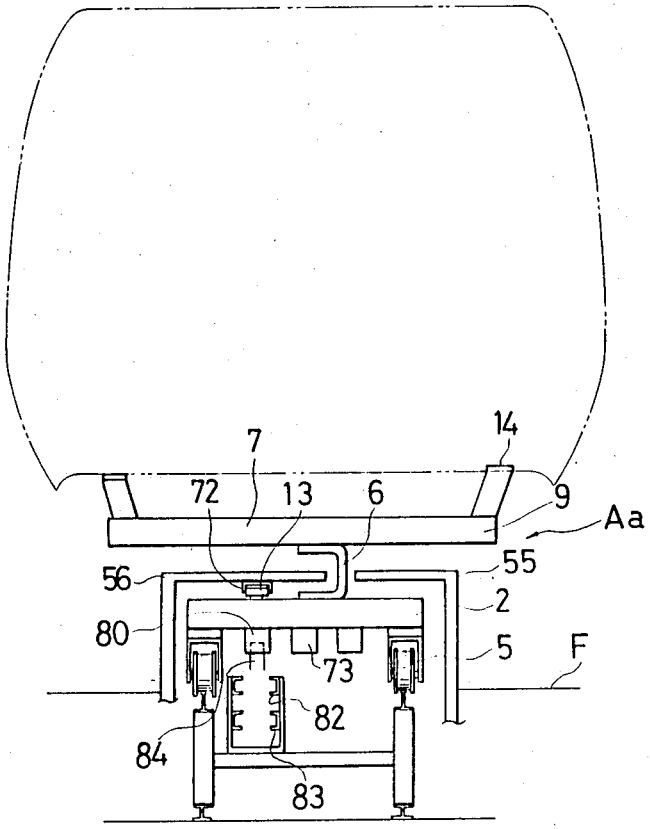
Figure 11:
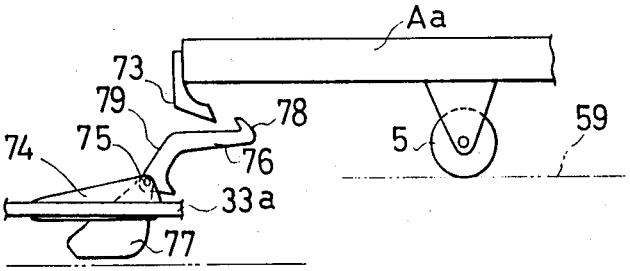

Referring to FIGS. 9 to 11, there is shown an embodiment employing a carriage or a conveyance unit Aa of a greater length than the load M to dispense with the carrier links 29 and 30. In these figures, the component parts which are common to the foregoing embodiment are designated by common reference numerals. In this embodiment, a pusher plate 73 projects downwardly from the front end of the lower frame 2, while a hook member 78 is pivotally mounted by a pin 75 on the attachment 74 of a drive chain 33*a*, urging the hook member 78 by a pendant weight 77 into a position for engagement with the pusher plate 73. The front portion of the hook member 76 forms an inclined surface 79, and an uncoupling member 81 of the same height as the inclined surface 79 is fixed on the rear end of the lower frame 2.

If a stopper (not shown) is projected across the path of travel and hits against the inclined surface 79 when the carriage Aa is being pushed forward by engagement of the pusher plate 73 with the hook 78, the hook member 76 is turned downward to disengage the hook 78 from the pusher plate 73, stopping the carriage Aa. If a succeeding carriage Aa approaches, it is similarly stopped as the hook is disengaged by the uncoupling member 81 of the preceding carriage which rides onto the inclined surface 79. In this manner, the carriage Aa can be put in storage.

If a preceding one of the carriages in storage is started, the hook member 76 of the next carriage rises up and automatically engages a hook 78 which arrives next, starting the carriages Aa one after another.

The pusher 73, which is projected downwardly from the lower frame 2 for pushing forward a carriage Aa, is driven by an ordinary dual trolley conveyor chain. However, in order to preclude the adverse effects of degradations in accuracy of the transfer position of the carriage 1 due to elongation of the drive chain 33*a* or the like in a case where painting robots are used, it is desirable to provide in the painting booth another carrier rail 82 and a support rail 83 for the carrier drive chain on one side of the center line of the travel path, pushing forward or rearward a pusher 80 by means of a dog 84 (similar to the bifurcated coupling portion 71) which is provided on the carrier. In this embodiment, the carriage is also retained in a correct position in the transverse direction by guide rollers 13 and guide rail 72.

Figure 12:
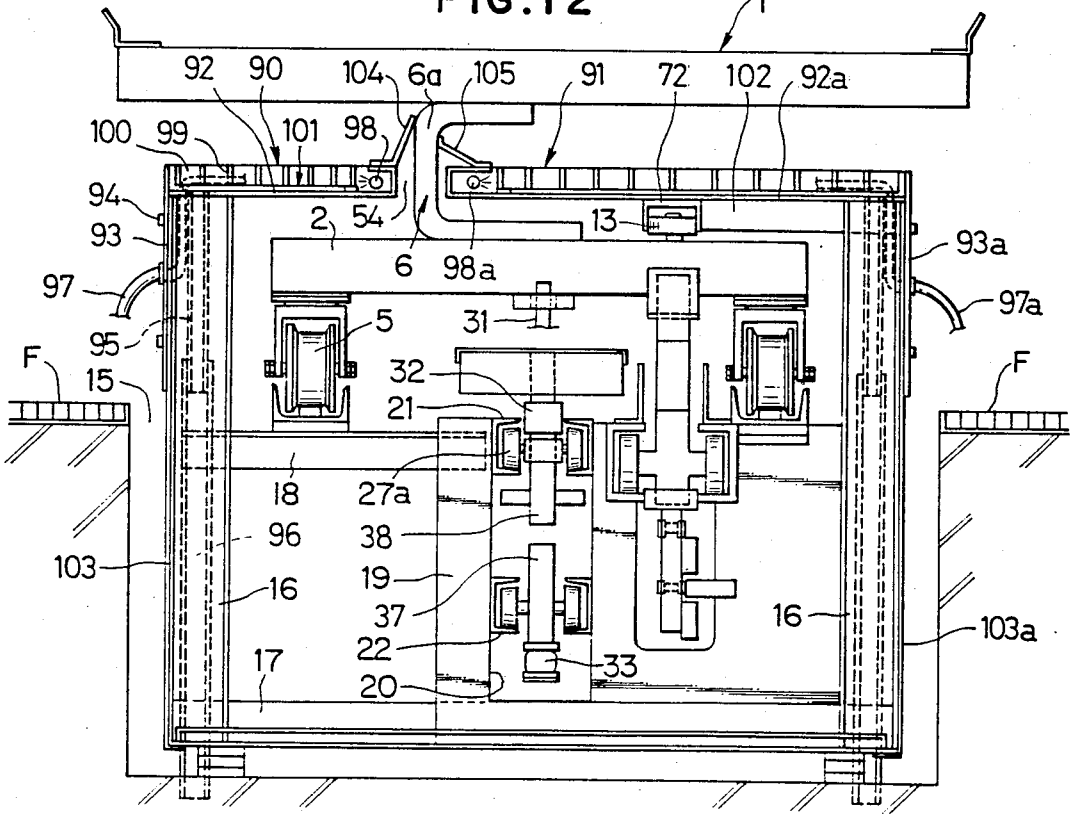
FIG. 12 is a sectional view of an alternate embodiment of a dust cover, showing the carrier as taken on line 12—12 of FIG. 5.

Illustrated in FIG. 12 is an alternate embodiment of the dust cover having a construction which facilitates removal of the paint deposited on the dust cover 57, and in which component parts common to the embodiments of FIGS. 1 to 11 are designated by common reference numerals.

In the paint booth, dust guard covers 90 and 91 are opposingly fixed on the upper ends of the support columns 16 in the pit 15 to close its upper opening except the passage slot 54 for the vertical portions 6*a*. The dust covers 90 and 91 are each constituted by a large number of cover units which are connected end-to-end in the travel direction. These dust covers 90 and 91 have the same construction except the lengths of horizontal portions shown in FIG. 12, so that the construction of only one dust cover 90 is explained below, omitting explanation of the other dust cover 91 which is simply indicated by a suffix "a".

The dust guard cover 90 includes a square shallow tray 92 and a vertical cover plate 93 fixed to the outer end of the tray and extending almost to the floor surface F. The tray 92 is mounted on the support columns 16, and the cover plate 93 is fixed to the support columns 16 by bolts 94. In this state, a water drain pipe 95 which is fixed to the tray 92 is inserted into the upper end of a fixed water drain pipe 96. Also attached to the tray 92 is a water feed pipe 98 which is connected to a water supply hose 97. The paint which falls or flows into the tray 92 is washed away with water from the water feed pipe 98 and discharged to the outside through the water drain pipes 95 and 96. Placed in the tray 92 is a duckboard-like grating 101 with longitudinal and transverse slats which are integrally formed of a metallic or synthetic resin material. The slats are made of thin-wall material to reduce the surface on which paint may be deposited. This grating 101 should be sufficient in strength for permitting an operator to walk thereon.

The passage slot 54 is provided in a position which is deviated toward one side from the longitudinal center line of the travel path, for preventing contamination of structural parts of the conveyor by the paint entering through the groove. Accordingly, since the dust cover 91 has a larger extension length from the support columns 16 than the other dust cover 90, the lower side of the tray 92*a* is supported by beams 102 which are projected from the upper ends of the support columns 16. A channel member 72 for receiving the guide roller 13 is fixed at the inner ends of the beams 102. This guide roller 13 serves to hold the carriage accurately in position in the transverse direction. The cover plates 93 and 93*a* of the dust covers 90 and 91 are overlapped on lower cover plates 103 and 103*a* to cover the entire side surfaces of the conveyor.

As described hereinbefore, the dust covers 90 and 91 and cover plates 93 and 93*a* enshroud in a tunnel-like fashion the top surface of the lower frame 2 except the passage slot 54 as well as the entire lateral surfaces of the transfer path below the lower frame 2. Therefore, in a case where the passage groove 54 is of a small width, intrusion of the paint can be prevented sufficiently even if the passage groove 54 is kept in open state. However, in order to enhance the shielding effect of the dust cover, it is recommended to cover the passage slot 54 with flaps of flexible or resilient strips 104 and 105 which are fixed at one side thereof on the inner folded-back end of the tray 92 or 92*a*. The resilient strips 104 and 105 are locally turned up when a vertical portion 6*a* passes. With this arrangement, it becomes possible to completely prevent paint deposition on movable parts which are located beneath the lower frame 2, namely, on swivelable wheels 5, carrier links 29 and 30, drive chain 33 and the like.

In the tray 92, the paint deposits only in a little amount on the slats 99 and 100 which are normally small in thickness, and an operator can walk on the grating 101 safely without slips to go to the other side of the conveyor or to perform a painting or other job on the grating. When the paint has deposited on the grating 101 to a large extent, it can be removed simply by washing the grating after detaching same from the trays 92 and 92*a*.

Figure 13:
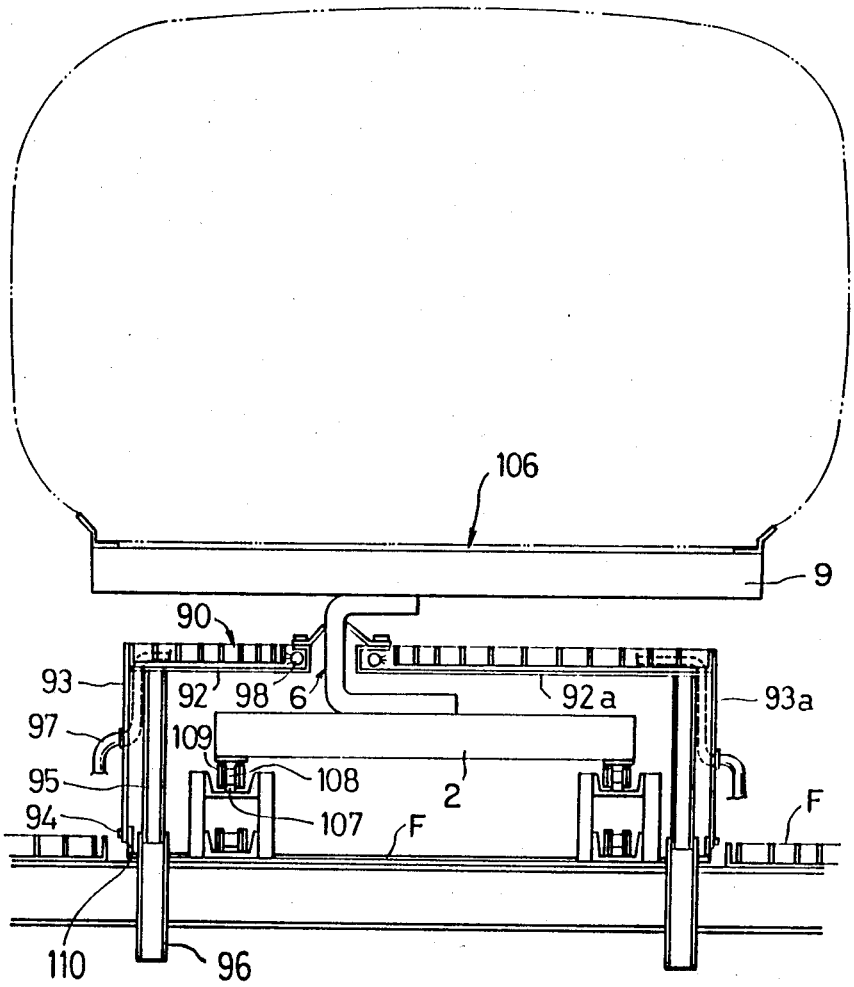
FIG. 13 is a view similar to FIG. 12 showing a different carrier drive and support system.

Illustrated in FIG. 13 is a similar dust cover for apparatus employing another carriage which is different in construction from the one shown in FIG. 12. Namely, the lower frame 2 of a pallet 106 has the opposite side portions thereof supported directly on links 109 of drive chains 108 with rollers which run on fixed rails 107 above the floor surface F for moving the pallet. In this figure, the component parts common to FIG. 12 are designated by common reference numerals. In this embodiment, the vertical portions 93 and 93*a* of the dust cover are fastened to fixed support members 110 on the floor by means of bolts 94.

According to the first embodiment of the invention, the flat carriage is always supported by the wheels 5 which are guided by rails, so that it can always travel in stabilized state. However, the necessity for providing the guide rails for the carriage wheels over the entire length of the transfer path gives rise to the problem of high cost, in addition to the possibilities of degradation of coated surfaces by dust which is whirled up in the paint drying oven by rolling movements of the carriage wheels.

Referring to FIGS. 14 to 21, there is shown a further embodiment which is arranged to move the carriage in a more stabilized state in a particular zone (e.g., in a paint booth) than in normal traveling condition, and in which the component parts common to the embodiments of FIGS. 1 to 11 are designated by common reference numerals.

A pit 65 of a square shape in section is similarly dug out under the floor surface F to provide a travel path for the carriage unit 120.

Figure 14:
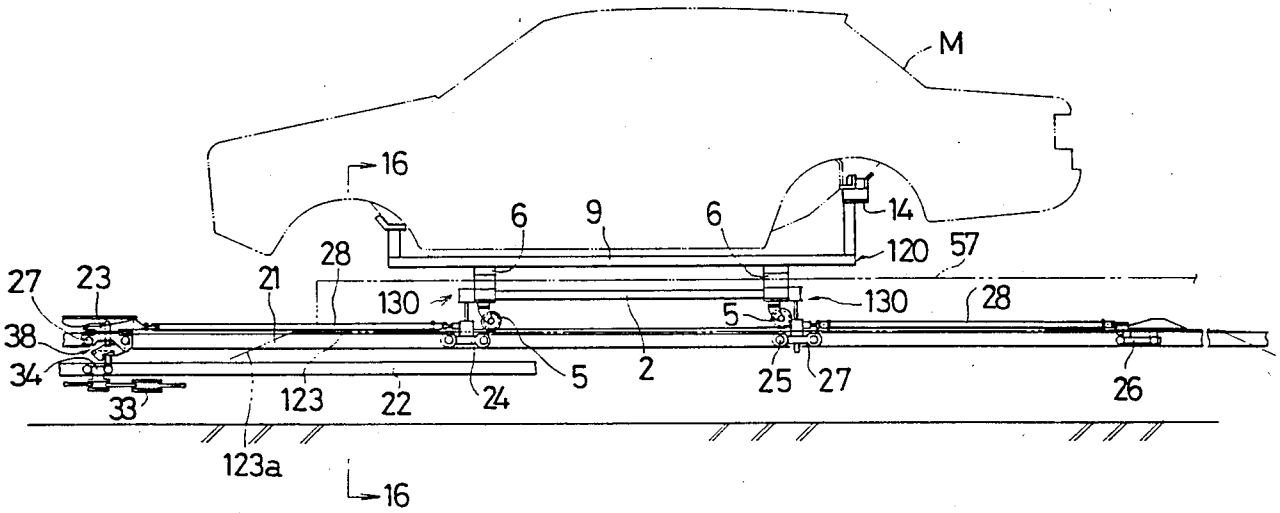
Figure 15:
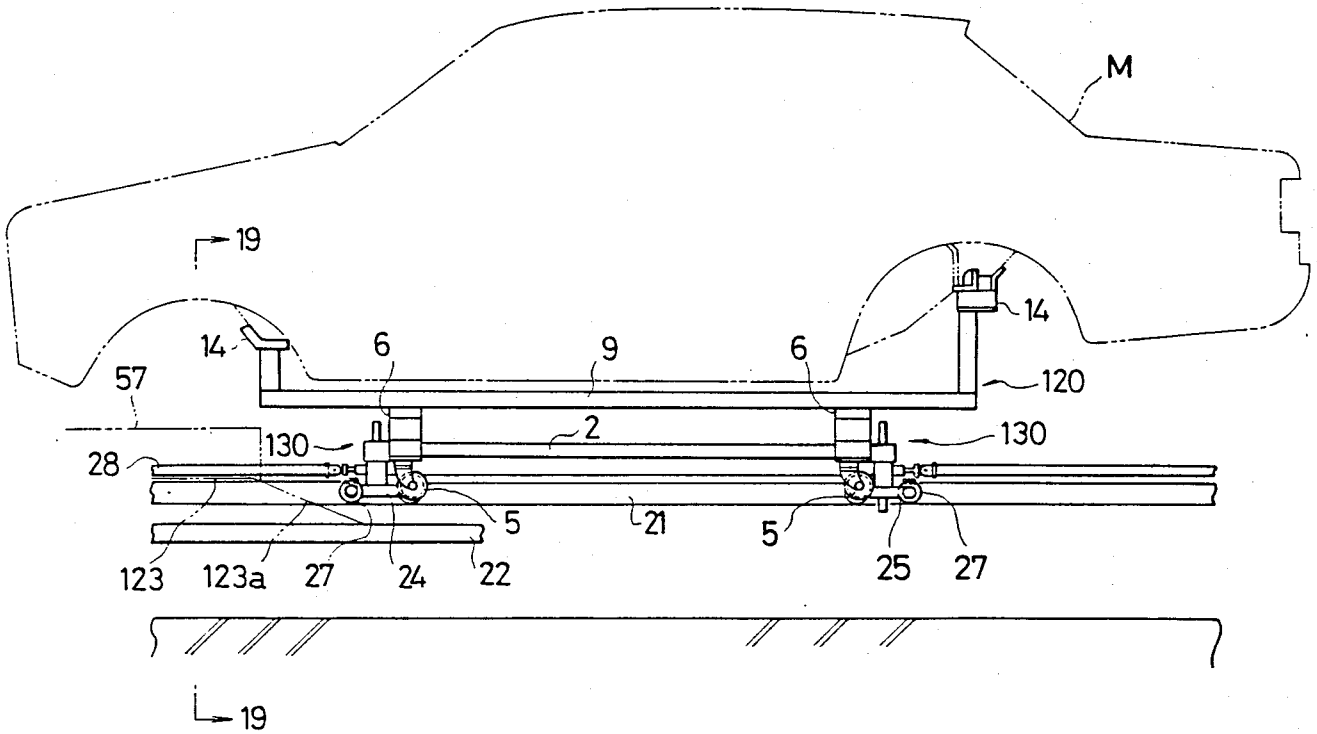
Figure 21:
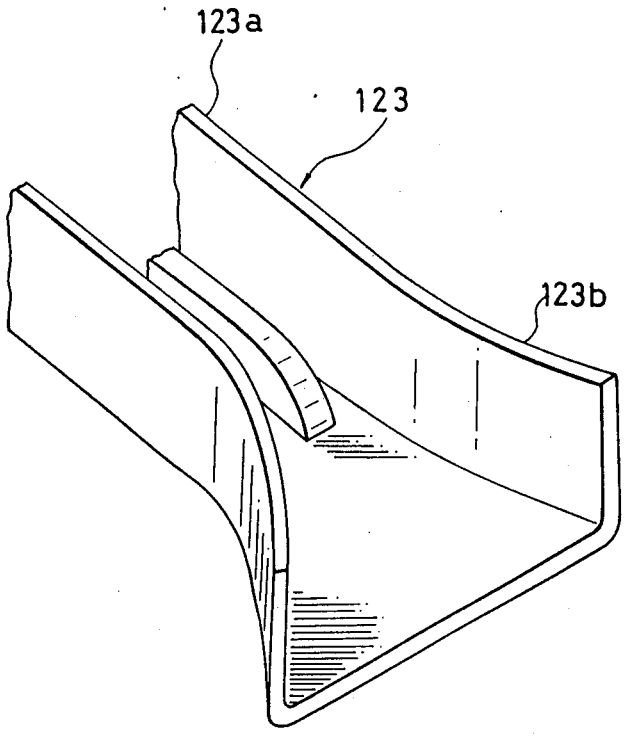

A pair of channel members of U-shape in section are supported in the pit 15 oppositely spaced from each other by support plates 121 (FIG. 16) and 122 (FIG. 19) which are located within the pit 15 at predetermined intervals, to serve as a chain rail 22 and a carrier rail 21. Mounted parallel on the support plates 121 within the dust cover 57 are gutter-like wheel guide rails 123 as examples of guide rails for the swivelable wheels 5. These gutter-like rails 123 are laid only for the portion of the path of travel within the dust cover 57, and have downslope or ramp portions 123*a* at their entrance and exit ends (FIGS. 15 and 14, respectively). As shown in FIG. 21, a converging gate portion 123*b* is formed at the entrance end of the downslope portion 123*a* to correct the direction of the swivelable wheel which is about to enter the gutter-like rail 123.

Provided between the lower frame 2 of the carriage unit 120 and the trailing and follower carriers 24 and 25 are couplers 130 for connecting the carriage unit 120 to the latter.

The couplers 130 on the front and rear portions of the carriage 120 are of the same construction, and therefore only the coupler which is mounted at the front end of the carriage (the one on the left side in FIG. 14) is described hereafter with reference to FIGS. 16 to 19.

A pair of brackets 131 project vertically and parallel to the front side of the lower frame 2, and a coupling member 132 is rotatably mounted between the brackets 131 by means of laterally extending horizontal shafts or pins 133. The coupling member 132 is provided with a coupling hole 134 vertically therethrough. Engaged in this coupling hole 134 snugly in a rattle-free state is a tow pin 135 which vertically projects from the main body 24*a* of the trailing carrier 24. The tow pin 135 is pivotably connected to the main body 24*a* by a pin 136.

The embodiment shown in FIGS. 14 through 21 operates in the following manner.

When the carriage 120 is in a position outside the dust guard cover 57 and where the gutter-like rails 123 are not laid (see FIG. 19), it is supported by the carriers 24 and 25 instead of by the swivelable traveling wheels 5, with the coupling members 132 of the couplers 130 superposed directly on the bodies 24*a* of the carriers 24 and 25. In this state, the drive chain 33 is actuated to move the drawing carrier 24 on the carrier rail 21 through the trolley 34, coupler 38, head carrier 23 and coupling rod 28. Whereupon, the carriage unit 120 is moved on and along the carrier rail 21, supported by the drawing and follower carriers 24 and 25.

Figure 16:
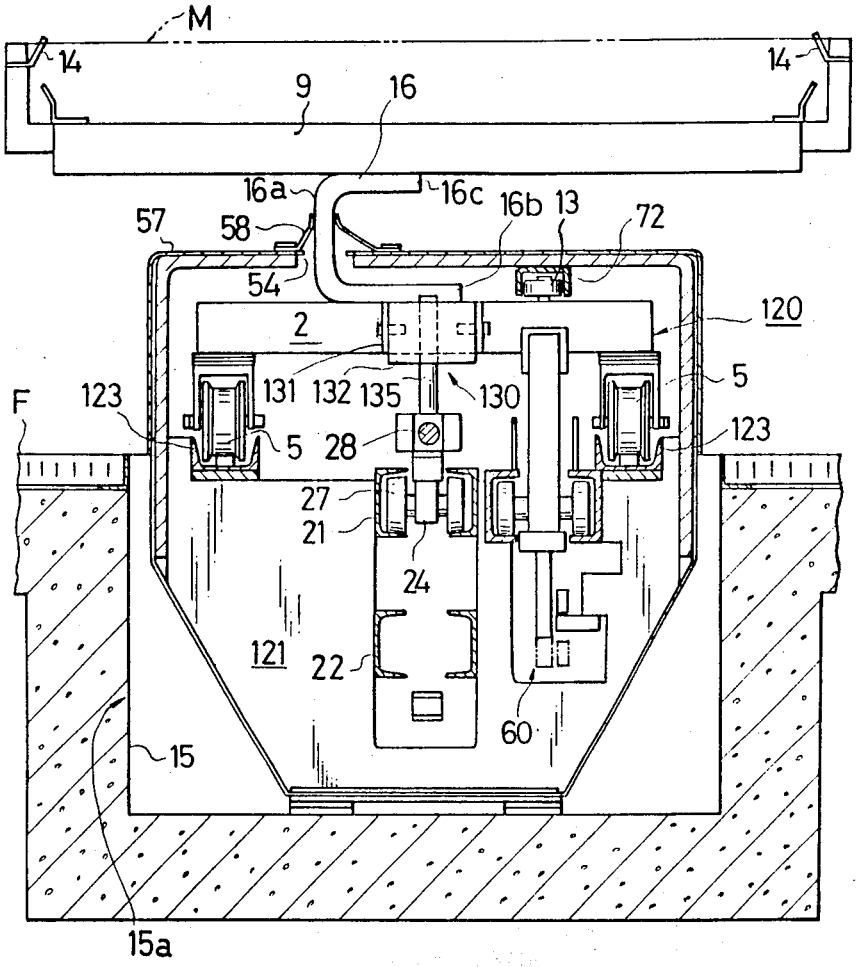
Figure 17:
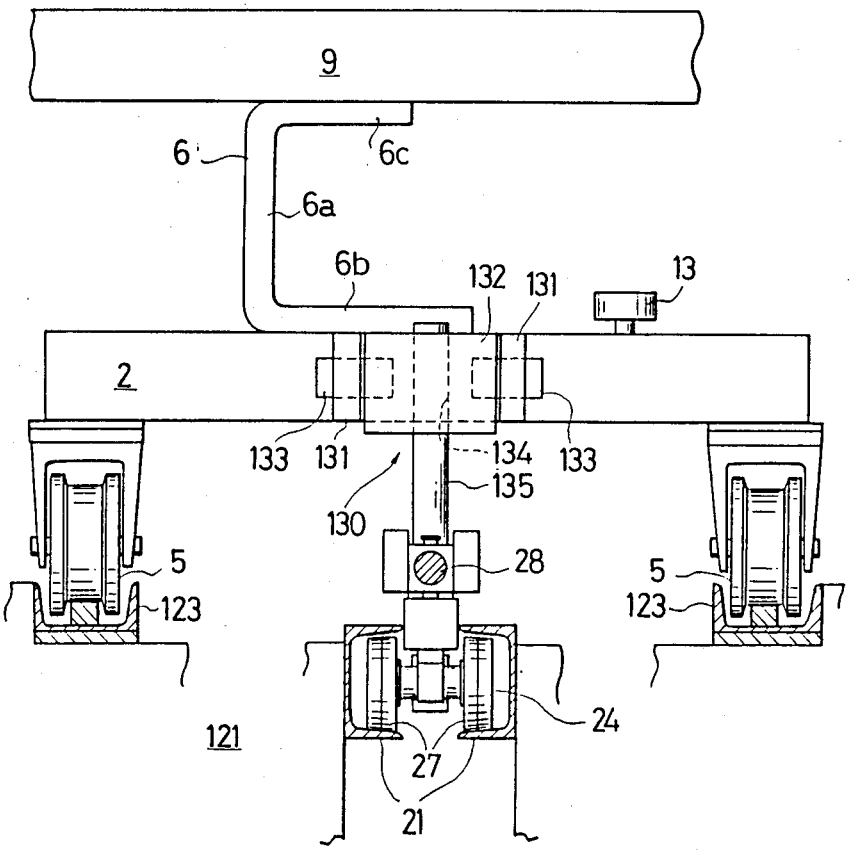
Figure 18:
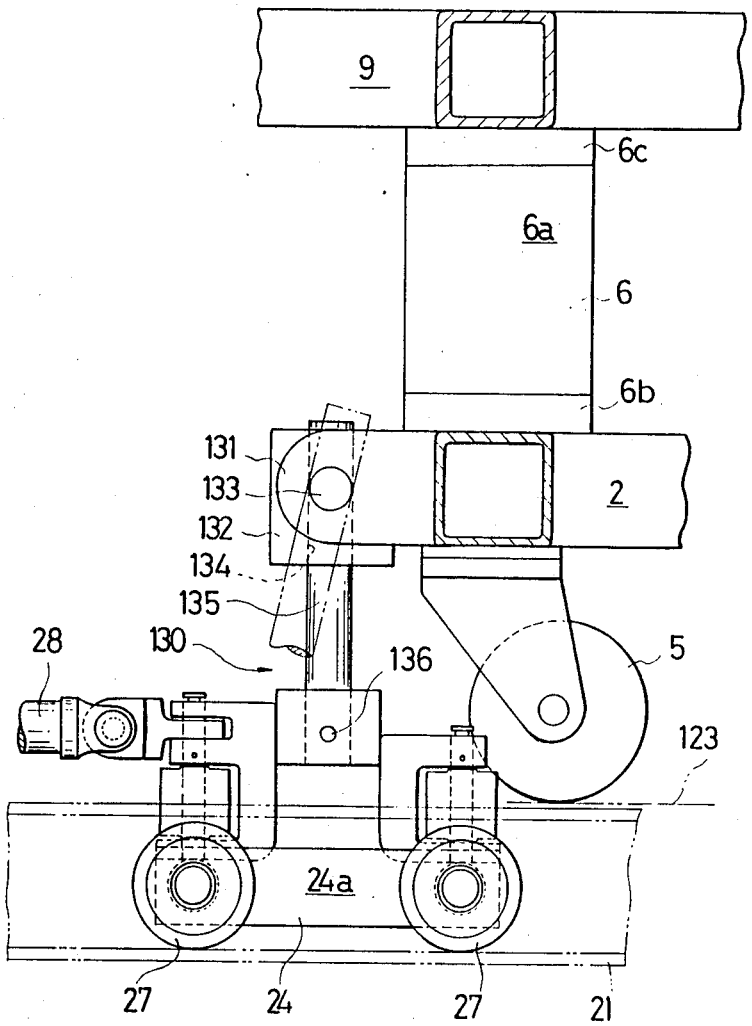

As soon as the carriage 120 is moved to a point near the entrance of the dust guard cover 57, the directions of the swivelable wheels 5 are corrected by the converging portions 123*b* of the gutter-like rails 123 to ride onto the entrance ends of the ramp portions 123*a*, pushing up the carriage 120 onto the gutter-like rails 123 with the movement of the drive chain 33. On the other hand, the carriers 24 and 25 are horizontally moved on the rail 21. At this time, as a result of the upward movement of the carriage 120, the coupling members 132 of the couplers 130 are moved away from the carrier bodies 24*a* and 25*a* and guided upwardly by the tow pins 135 as shown in FIGS. 16 to 18, permitting smooth upward movement of the carriage 120, causing the roller 13 to engage in the downwardly-open track 72. Accordingly, the carriage 120 which has been supported by the carriers 24 and 25 in the preceding horizontal movement is now supported by the swivelable wheels 5 in an upward movement away from the carriers 24 and 25 and in a succeeding horizontal movement. During these movements, the vertical portions 6*a* of the connecting posts 6 are passed through the passage slot 54 of the dust cover 57.

While the lower frame 2 moves within the dust cover 57, the carriage 120 is drawn by the carrier 24 (or by the aforementioned secondary drive mechanism 0), and the load of the carriage as a whole is supported by the gutter-like wheel-guide rails 123 which guide the swivelable wheels 5.

After passing through the dust guard cover 57, the carriage 120 is gradually lowered as the swivelable wheels 5 are lowered under guidance of the ramp portions 123*a* of the rails 123. At this time, the coupling members 132 are lowered together with the carriage 120, guided by the tow pins 135 while the coupling members 132 engage the body 24*a*, and the wheels are then suspended above the exit end of the ramp. As soon as the swivelable wheels 5 come off the gutter-like rails 123, the coupling members 132 of the couplers 130 are directly supported by the bodies 24*a* and 25*a* of the carriers 24 and 25, and the carriage 120 which is now supported by the carriers 24 and 25 moves on the carrier rail 21.

Figure 19:
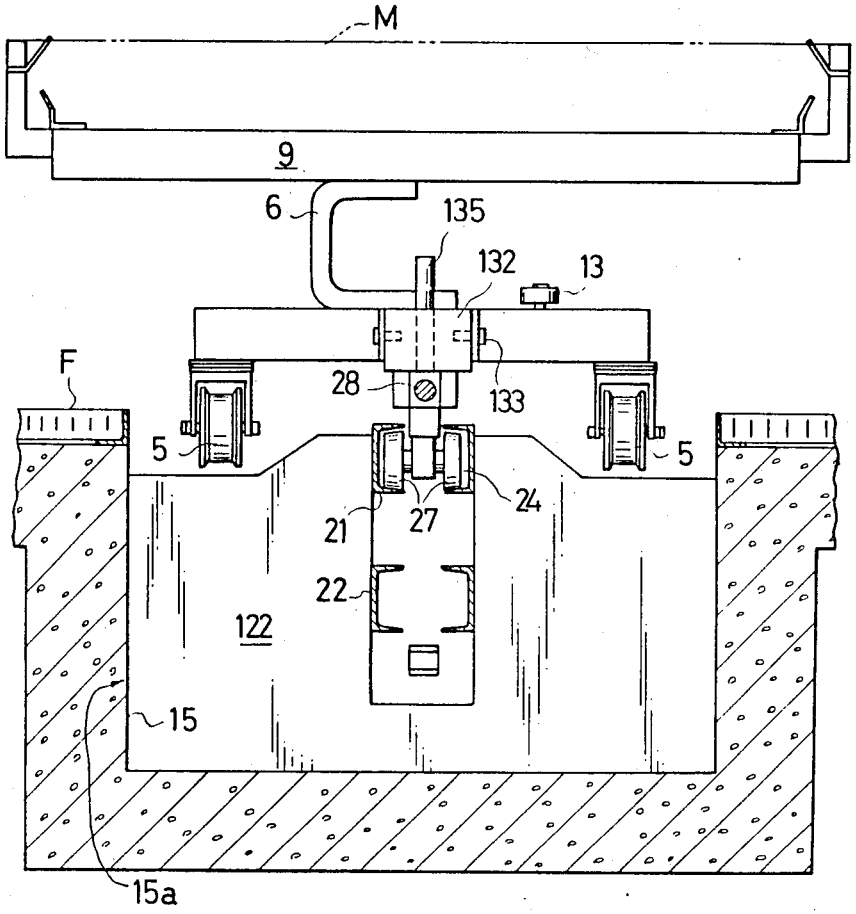
Figure 20:
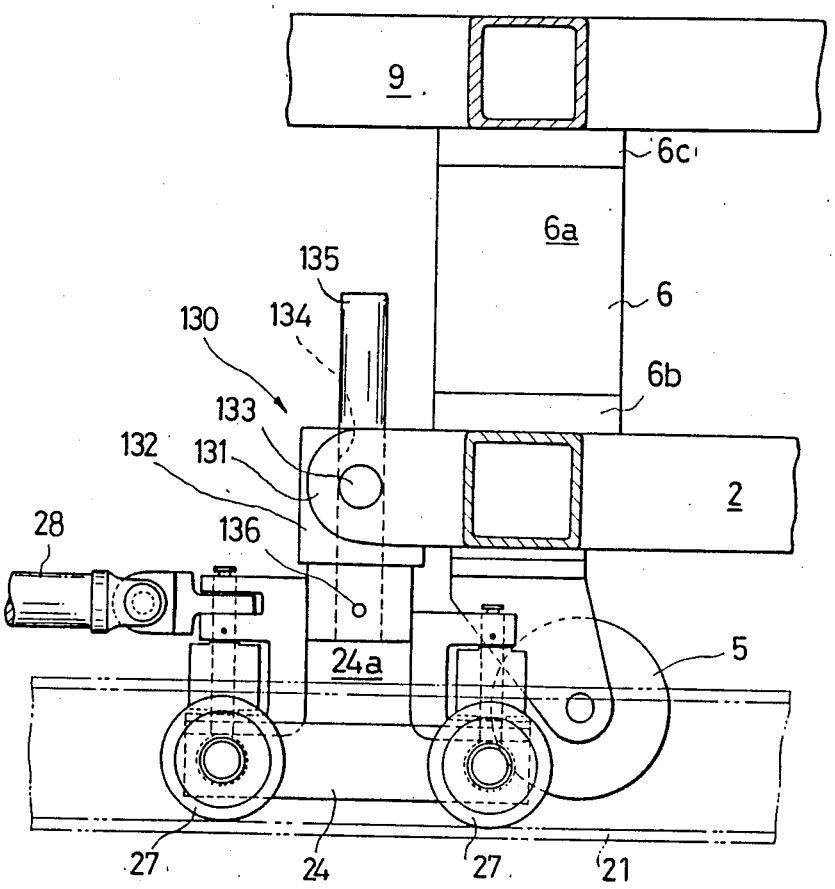

When the carriage 120 is lifted, lowered or turned horizontally during its travel, the coupling member 132 can cope with these movements as it can make an upward or downward movement or a horizontal turn relative to the tow pin 135 in addition fore and aft rocking movements about the horizontal axes of the rocking pins 133 and 136. Further, there is no possibility of turnover of the carriage 120, even when it is inclined sidewards, since the tow pin 135 is snugly fit in the coupling hole 134 of the coupling member 132, and the carrier rail has a sufficient strength to retain the carrier rollers (27 etc.) in place by means of its upper flange as shown in FIG. 19.

In the embodiment of FIGS. 14 to 21, when the lower frame 2 is moved within the dust cover 57 of the coating booth, the carriage 120 is moved stably by the swivelable wheels 5 under guidance of the gutter-like rails 123 without sideward wavering to ensure a high quality coating operation.

The absence of the gutter-like rails 123 outside the dust guard cover 57 simplifies the construction, and, since the carriage 120 in this zone is moved in the lowered position by the carriers 24 and 25, its center of gravity is lowered, permitting stabilized movements free of sideward wavering.

Further, the swivelable wheels 5 are suspended above the floor and are not rotated when passing through a paint drying oven (not shown), precluding generation of dust which would deteriorate the quality of the coated surfaces.

The coupling members 132 of the couplers 130 may be completely disengaged from the tow pin 135 so that the carriage unit 120 is released from the carriers 24 and 25 and can be used freely independently of the transfer path 15*a*. The swivelable wheels 5 are conveniently used in such a case.

The foregoing description has shown the travel within the painting booth as an example of the zone which needs a stabilized and controlled travel of the carriage. However, needless to say, the present invention is not limited to such an application.

Effects of the Invention

As described hereinbefore, the carriage is moved in a stable posture by the traveling wheels, and the load-mounting upper frame and the wheeled lower frame are connected by posts each with a vertical portion of a small width in the transverse direction, so that the dust guard cover can envelop the lower frame and all of its transfer drive parts in a paint booth except the passage slot for the vertical portions to preclude paint deposition on the traveling wheels and other movable parts.

Further, it is also possible to employ a secondary drive mechanism for ensuring higher accuracy in transfer position of the carriage in a case where coating robots are used, or to provide guide rollers and covering rail to hold the conveyance in a correct position in the transverse direction to make high quality coating operations easy.

Moreover, washing of the dust guard cover is easy because it suffices to wash the grating alone, which can be performed simply by the use of high pressure water.

The dust guard cover is removable for inspection of conveyor drive parts. The dust cover is conveniently used in coating operations as one can walk or carry out a manual coating operation on the dust cover.

Furthermore, it becomes possible to obtain a carriage-type conveyor which can be moved in a more stabilized state in a particular zone than in a normal traveling condition.

The features described above may be combined or used separately, and may be otherwise modified or supplemented within the scope of the present invention, as defined in the appended claims.

What is claimed:

1. An assembly having a conveyor unit for travel in series with like units at spaced intervals in a predetermined path, comprising:

a lower frame having wheels;

an upper frame for supporting a load;

post members having upright post portions supporting said upper frame above said lower frame, all of said post portions being aligned longitudinally of said predetermined path;

a chain guide extending along said predetermined path;

drive means conveying said lower frame along said chain guide;

drive coupling means at the front end of said lower frame having an operative position connecting said lower frame to said drive means to effect conveyance, and an inoperative position disconnecting said lower frame and said drive means to inactivate said conveyance;

drive uncoupling means at the rear end of said lower frame operable to displace the drive-coupling means of a succeeding unit in said series to said inoperative position when said spaced interval is closed; and a dust cover enveloping said drive means, said drive coupling means and said drive uncoupling means in at least a selected zone of said path, said cover having a top wall with parts extending between said lower and said upper frames and confronting each other to form a slot along said selected zone of said predetermined path through which said aligned post portions may travel.

2. A conveyor assembly according to claim 1 wherein said lower frame has carriages at its front and rear ends; and a carrier rail extending along said chain guide to define said predetermined path, and operable to guide said carriages therealong;

said drive coupling and drive uncoupling means being mounted on said carriages.

3. A conveyor assembly according to claim 2 wherein the carriages at said front and rear ends extend beyond said upper frame in the direction of travel of said unit.

4. A conveyor assembly according to claim 1 including a flexible resilient flap secured to one part of said cover top wall and extending over said slot, said flap being sufficiently flexible to be deflected by said post portions to afford travel of said post members through said slot.

5. An assembly having a conveyor unit for travel in series with like units at spaced intervals in a predetermined path, comprising: including:

a lower frame having wheels and a guide roller mounted on the top of said lower frame for rotation about a vertical axis;

an upper frame for supporting a load;

post members having upright post portions supporting said upper frame above said lower frame, all of said post portions being aligned longitudinally of said predetermined path;

a chain guide extending along said predetermined path;

drive means conveying said lower frame along said chain guide;

drive coupling means at the front end of said lower frame having an operative position connecting said lower frame to said drive means to effect conveyance, and an inoperative position disconnecting said lower frame and said drive means to inactivate said conveyance;

drive uncoupling means at the rear end of said lower frame operable to displace the drive-coupling means of a succeeding unit in said series to said inoperative position when said spaced interval is closed;

a dust cover enveloping said drive means in at least a selected zone of said path, said cover having a top wall with parts extending between said lower and said upper frames and confronting each other to form a slot along said selected zone of said predetermined path through which said aligned post portions may travel; and a downwardly-open channel-shaped guide rail mounted on the underside of said cover top wall parallel to said carrier rail and in registry with said guide roller to stabilize said conveyor unit against sideways movement.

6. An assembly according to claim 5 wherein said post portions are offset at one side of the longitudinal centerline of said predetermined path and said guide rail is offset at the other side of the longitudinal centerline.

7. An assembly having a conveyor unit for travel in series with like units at spaced intervals in a predetermined path, comprising:

a lower frame having wheels;

an upper frame for supporting a load;

post members having upright post portions supporting said upper frame above said lower frame, all of said post portions being aligned longitudinally of said predetermined path;

a chain guide extending along said predetermined path;

drive means conveying said lower frame along said chain guide;

drive coupling means at the front end of said lower frame having an operative position connecting said lower frame to said drive means to effect conveyance, and an inoperative position disconnecting said lower frame and said drive means to inactivate said conveyance; and drive uncoupling means at the rear end of said lower frame operable to displace the drive-coupling means of a succeeding unit in said series to said inoperative position when said spaced interval is closed, said drive means comprising a primary chain traveling on said chain guide and having a pusher cooperating with said drive coupling means operative to effect said conveyance along a portion of said path of travel, a secondary chain traveling alongside said primary chain in a second portion of said path of travel, and a coupling portion mounted on said secondary chain to engage said lower frame when said drive coupling means is inoperative and to effect movement of said conveyor unit with movement of said secondary chain in opposite directions of travel along said path.

8. An assembly according to claim 7 wherein said coupling portion of said secondary chain is mounted for vertical movement between an elevated operative position and a depressed inoperative position, and including a cam means to displace said coupling portion to said elevated operative position in said second portion of said path of travel when said drive coupling means is inoperative.

9. An assembly according to claim 7 including a dust cover enveloping said drive means in at least a selected zone of said path, said cover having a top wall with parts extending between said lower and said upper frames and confronting each other to form a slot along said selected zone of said predetermined path through which said aligned post portions may travel.

10. An assembly having a conveyor unit for travel in series with like units at spaced intervals in a predetermined path, comprising:

a lower frame having wheels;

an upper frame for supporting a load;

post members having upright post portions supporting said upper frame above said lower frame, all of said post portions being aligned longitudinally of said predetermined path; mined a chain guide extending along said predetermined path;

drive means conveying said lower frame chain guide;

drive coupling means at the front end of said lower frame having an operative position connecting said lower frame to said drive means to effect conveyance, and an inoperative position disconnecting said lower frame and said drive means to inactivate said conveyance;

drive uncoupling means at the rear end of said lower frame operable to displace the drive-coupling means of a succeeding unit in said series to said inoperative position when said spaced interval is closed; and a dust cover enveloping said drive means in at least a selected zone of said path, said cover having a top wall with parts extending between said lower and said upper frames and confronting each other to form a slot along said selected zone of said predetermined path through which said aligned post portions may travel, trays on the upwardly facing surfaces of said parts, means to introduce water into said trays to flush particles deposited in said trays, and drain means to discharge the flushing water from said trays.

11. An assembly according to claim 10 including a grating detachably positioned in said trays, said grating comprising longitudinal and transverse slats formed of thin-wall material of sufficient strength to allow an operator to walk on the grating without slipping.

12. For a painting and drying line having a painting booth, a conveyor assembly comprising a conveyor unit for travel in a predetermined path including a zone within said painting booth in which the conveyor unit is stabilized against lateral sway, comprising:

a frame having swivelable wheels at four corners for supporting a load;

a carrier supporting said frame, and a carrier rail to define said predetermined path and operable to support and guide said carrier therealong;

drive means extending along said predetermined path conveying said carrier and said frame along said carrier rail;

drive coupling means on said carrier having an operative position connecting said carrier to said drive means to effect conveyance, and an inoperative position disconnecting said carrier and said drive means to inactivate said conveyance; and wheel-guide rails underlying the swivelable wheels of said frame in said painting booth zone to stabilize the lower frame against lateral sway, said wheel-guide rails having entrance gates to orient the wheels in the rails, and entrance and exit ramps, respectively, to elevate said wheels and said frame as the wheels enter the rails and to lower said wheels and said frame as the wheels exit the rails, whereby said wheel-guide rails support said unit in the painting zone.

13. An assembly according to claim 12 wherein said frame rests upon said carrier in the lowered position of said wheels and said frame, said wheels in the lowered position being suspended so that said carrier provides the sole support for said frame outside of said painting booth zone.

14. An assembly according to claim 13 wherein said carrier is coupled to said frame by a post permitting disengagement of said frame from said carrier by relative upward displacement of the frame above said elevated position determined by said wheel-guide rails.

* * * * *

UNITED STATES PATENT AND TRADEMARK OFFICE

CERTIFICATE OF CORRECTION

PATENT NO. : 4,811,685

DATED : March 14, 1989

INVENTOR(S) : Masasumi Murai

It is certified that error appears in the above-identified patent and that said Letters Patent is hereby corrected as shown below:

Col. 2, line 1, before "travel;" insert --of--;

Col. 11, line 57, "0" should be --60--;

Col. 15, line 30, delete "mined";

Col. 15, line 33, after "frame" insert --along said--.

Signed and Sealed this

Seventeenth Day of October, 1989

*Attest:*

DONALD J. QUIGG

*Attesting Officer*

*Commissioner of Patents and Trademarks*